US006474935B1

(12) United States Patent
Crotty et al.

(10) Patent No.: US 6,474,935 B1
(45) Date of Patent: Nov. 5, 2002

(54) OPTICAL STALL PRECURSOR SENSOR APPARATUS AND METHOD FOR APPLICATION ON AXIAL FLOW COMPRESSORS

(75) Inventors: Timothy Crotty, Greenville, SC (US); John M. Delvaux, Greer, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/853,876

(22) Filed: May 14, 2001

(51) Int. Cl.[7] ..... F01D 21/04

(52) U.S. Cl. ..... 415/1; 415/14; 415/914; 415/118

(58) Field of Search ..... 415/1, 13, 914, 415/118, 14; 416/35, 61

(56) References Cited

U.S. PATENT DOCUMENTS 3,680,363 A * 8/1972 Holz et al. ..... 73/660
3,867,717 A 2/1975 Moehring et al.
4,326,804 A * 4/1982 Mossey ..... 250/224
4,955,269 A * 9/1990 Kendig et al. ..... 73/116
RE34,388 E 9/1993 Dubin et al.
6,010,303 A * 1/2000 Feulner ..... 415/118
6,164,902 A * 12/2000 Irwin et al. ..... 415/118

* cited by examiner

*Primary Examiner*—Edward K. Look
*Assistant Examiner*—Ninh Nguyen
(74) *Attorney, Agent, or Firm*—Nixon & Vanderhye P.C.

(57) ABSTRACT

A stall precursor detector system for an axial flow compressor having at least one optical sensor to detect the deflection of a rotating airfoil of the compressor, means for comparing the deflection with a predetermined value, the predetermined value being indicative of onset of a stall in the compressor; and means for identifying onset of a stall and producing a stall onset signal if the deflection is greater than the predetermined value. A method for detecting a stall onset in an axial flow compressor system comprising (a) providing at least one optical sensor to measure the deflection of an airfoil, the deflection caused by a rotating stall cell; (b) comparing the deflection as measured in step (a) with a predetermined value indicative of a stall; and (c) identifying onset of a stall if the measured deflection is greater than the predetermined value.

11 Claims, 5 Drawing Sheets

OPTICAL STALL PRECURSOR SENSOR APPARATUS AND METHOD FOR APPLICATION ON AXIAL FLOW COMPRESSORS

BACKGROUND OF THE INVENTION

This invention relates to axial flow compressors and, more particularly, to a method for detecting stall onset in axial flow compressor systems using an optical sensor, such as a laser or light probe.

During operation of an aircraft gas turbine, there may occur a phenomenon known as compressor stall, wherein the pressure ratio or compressor operating limit line of the compressor initially exceeds the compressor surge pressure ratio, resulting in a subsequent reduction of compressor pressure ratio and airflow delivered to the engine combustor. Compressor stall may result from a variety of reasons, such as when the engine is accelerated too rapidly, or when the inlet profile of air pressure or temperature becomes unduly distorted during normal operation of the engine, or when over time, erosion has diminished the performance of the compressor airfoils. Compressor damage due to the ingestion of foreign objects or a malfunction of a portion of the engine control system may also result in a compressor stall. If a compressor stall remains undetected and permitted to continue, the combustor temperatures and the vibratory stresses induced in the compressor may become sufficiently high to cause damage to the turbine.

In land-based gas turbines used for power generation, a compressor must be allowed to operate at a high pressure ratio in order to achieve a high machine efficiency. A compressor stall, as identified above with respect to aircraft turbines, may also occur in land-based gas turbines. Similar to the problems faced during the operation of aircraft gas turbines, if a compressor stall remains undetected and permitted to continue in land-based gas turbines, the combustor temperatures and vibratory stresses induced in the compressor may become sufficiently high to cause damage to the turbine.

Several attempts have been made in an effort to determine whether a stall condition is imminent. Typically, the compressor discharge pressure is monitored and when the pressure rapidly drops this provides an indication of that a stall has already occurred. Methods to detect the onset of a compressor surge using pressure sensors have remained elusive. Also, existing experimental techniques require complex mathematical manipulation of very high response pressure signals to anticipate proximity to the surge line. Furthermore, the sensed pressure signals often fail to provide a clear indication of stall onset. These factors make the existing techniques difficult to reliably implement in new or fielded axial flow compression systems. Therefore, it would be desirable to have a reliable stall detection method and apparatus to detect the onset of a compressor surge prior to the event occurrence using an optical sensor, and using the information to initiate the desired control system corrective action.

BRIEF SUMMARY OF THE INVENTION

Accordingly, the present invention is directed to an innovative system and method for detecting the onset of stalls, in axial flow compressor systems, using an optical sensor, for example, a laser or light probe. In this method, at least one optical sensor is provided in the compressor to detect the deflection of airfoil caused by a rotating stall cell. The optical sensor monitors the deflection and vibratory response of a rotating airfoil by estimating the airfoil deflection by the time of arrival of each airfoil, with respect to a reference in a given compressor stage. Measured airfoil deflection values are compared with predetermined steady baseline values in a control algorithm. The electronic control initiates corrective actions, by means of a control algorithm if the measured deflection values are greater than the predetermined values. The predetermined value is estimated analytically and verified experimentally for incorporation into the engine electronic control.

The corrective actions may vary the operating line control parameters which include adjustments to compressor vanes, inlet air heat, compressor air bleed, combustor fuel flow, etc. to operate the compressor at a near threshold level, the level occurring near stall and presumably on a high operating line where maximum efficiency occurs. Preferably, the corrective actions are initiated prior to the occurrence of a compressor surge event and within a margin identified between an operating limit line and the occurrence of a compressor surge event. Corrective actions are iterated until the measured airfoil deflection values lie within acceptable parameters. Stall onset may also precipitate in an axial flow compressor system operating under high aerodynamic loading or high airflow incidence angle.

In one aspect, the present invention provides a method for detecting a stall onset in an axial flow compressor system comprising, (a) providing at least one optical sensor to measure the deflection of an airfoil, the deflection caused by a rotating stall cell; (b) comparing the deflection as measured in step (a) with a predetermined value indicative of a stall; and (c) identifying onset of a stall if the measured deflection is greater than the predetermined value. The method further includes the steps of (d) upon identifying a stall onset as in step (c), feeding the measured deflection to a control system to initiate corrective actions to prevent a compressor surge event; and (e) iterating step (d) until the measured deflection is less than the predetermined value to allow the compressor to operate at higher efficiency. The deflection of the airfoil is measured by measuring the time of arrival of the airfoil with respect to a reference. Further, corrective actions are initiated by varying operating line parameters. Preferably, the operating line parameters are set to a near threshold value.

In another aspect, a stall precursor detector system for an axial flow compressor, comprises at least one optical sensor to detect the deflection of a rotating airfoil of the compressor; means for comparing the deflection with a predetermined value , the predetermined value being indicative of onset of a stall in the compressor; and means for identifying onset of a stall and producing a stall onset signal if said deflection is greater than the predetermined value. The system further comprises a control system for initiating corrective actions to prevent a subsequent compressor surge if the deflection is greater than the predetermined value. The optical sensor measures the time of arrival of an airfoil to determine airfoil deflection. The system further comprises a system selector means for applying the stall onset signal to provide a warning of the stall onset.

In yet another aspect, a stall warning system for an axial flow compressor, comprising at least one optical sensor to detect and measure the deflection of an airfoil of said compressor; means for comparing the deflection with a predetermined value indicative of a stall onset; means for identifying onset of a stall if the measured deflection is greater than the predetermined value; and a feedback control system for initiating corrective actions to prevent a subsequent compressor surge upon identifying a stall onset.

The benefits of the present invention will become apparent to those skilled in the art from the following detailed description, wherein only the preferred embodiment of the invention is shown and described, simply by way of illustration of the best mode contemplated of carrying out the invention.

DETAILED DESCRIPTION OF THE INVENTION

Figure 1:
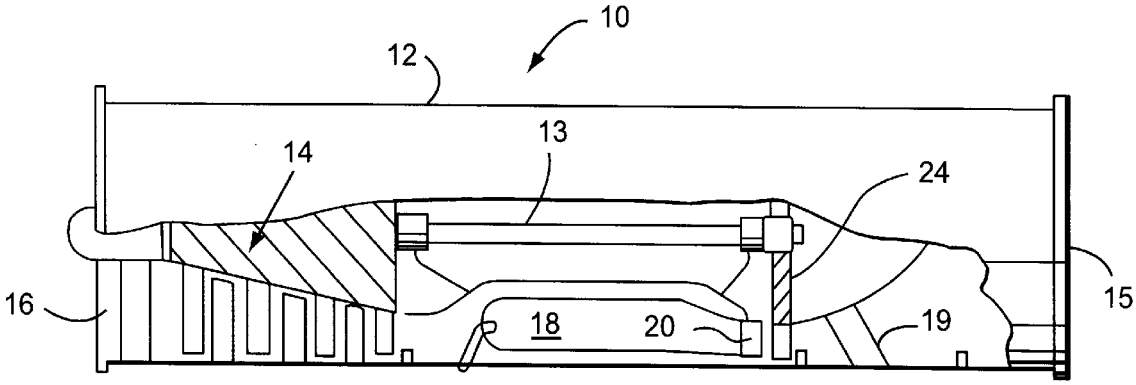
FIG. 1 is a schematic representation of a typical ground based power generation gas turbine or an aircraft gas turbine engine if the generator is removed.

Referring now to FIG. 1, a conventional aircraft gas turbine engine is shown at 10 as comprising a cylindrical housing 12 having a compressor 14, which may be of the axial flow type, within the housing adjacent to its forward end. Compressor 14 receives air through an annular air inlet 16 and delivers compressed air to a combustion chamber 18. Within the combustion chamber 18, air is burned with fuel and the resulting combustion gases are directed by a nozzle or guide vane structure 20 to the rotor blades of a turbine rotor 24 for driving the rotor. A shaft 13 drivably connects the turbine rotor 24 with the compressor 14. From the rotor blades, the exhaust gases discharge rearwardly through an exhaust duct 19 into the surrounding atmosphere. This configuration may be similar to the ground based power generation gas turbine engines.

Figure 2:
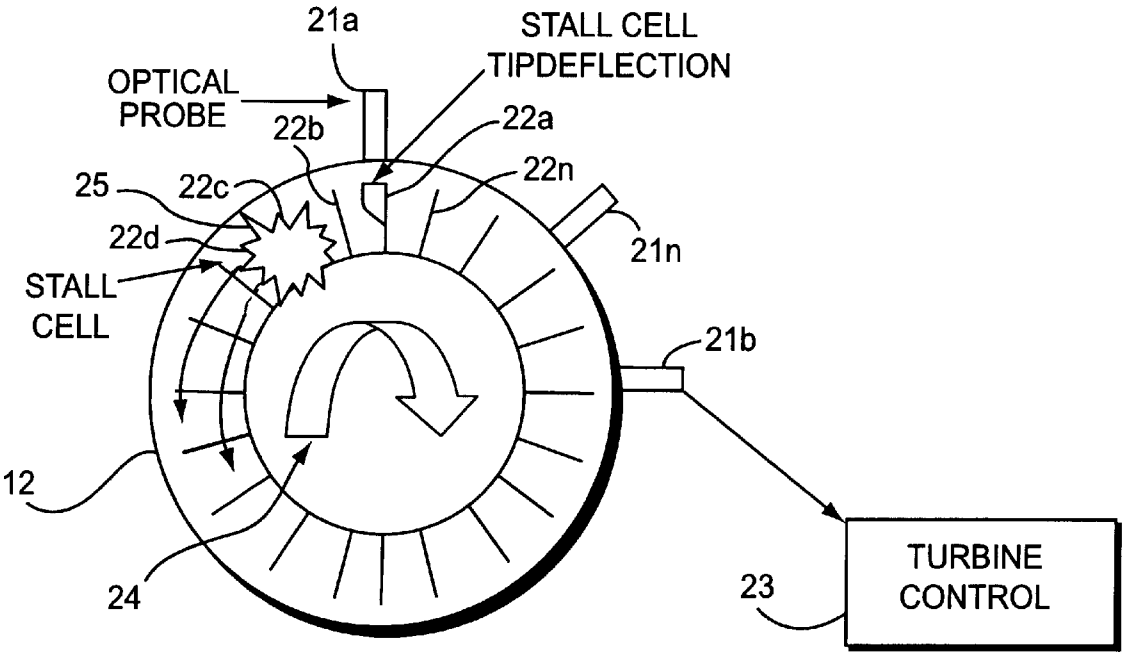
FIG. 2 illustrates a schematic representation of a stall precursor sensor in accordance with an exemplary embodiment of the present invention as connected to a typical gas turbine engine as shown in FIG. 1.

Referring now to FIG. 2, there is shown a schematic end view of the compressor 14, airfoils $\mathbf{22}_a$–$\mathbf{22}_n$ ("22"). The stall precursor sensor of the present invention includes a several of optical probes $\mathbf{21}_a$–$\mathbf{21}_n$ (hereinafter "21") disposed about the compressor 14. It may also be possible to locate the optical probes adjacent to the compressor 14. The light probes used are of the type that may be readily obtained off-the-shelf and manufactured by Fiber Optics, Inc. or Fiberguide, Inc. Each of the optical probes emits a beam of light, which may be from a laser or other light source, towards blades/airfoils 22. A stall cell 25 defined as a volume of high pressure gas that moves past the blades at a velocity less than the rotor speed, is shown in exemplary FIG. 2. The stall cell induces a deflection on the airfoils 22, and the deflection is detected by at least one of the optical probes 21 by measuring the time of arrival of an airfoil. The airfoil deflection alters the time of arrival. Thus, the deflection induced by the stall cell on an airfoil 22 is measured and compared against a set predetermined value of deflection indicative of a stall onset. The onset of localized stall cells produces a significant airfoil tip deflection which is detected and measured by optical probes 21. An identical argument may be made with airfoils subjected to high aerodynamic loading or high airfoil incidence angle.

If the measured deflection of airfoil 22 is greater than a predetermined value, then a signal indicative of stall onset is issued to initiate remedial actions by a turbine control system 23 to prevent a compressor surge event.

Figure 3:
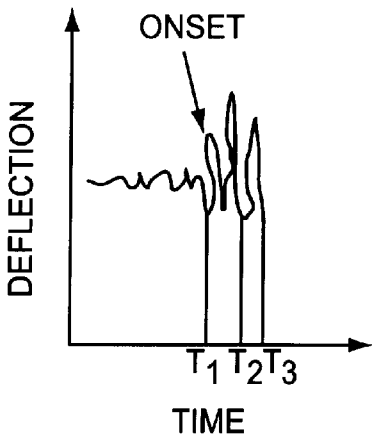
FIG. 3 depicts a chart showing a relationship between deflection of airfoil with respect to time and identifying onset of a compressor stall.
Figure 4:
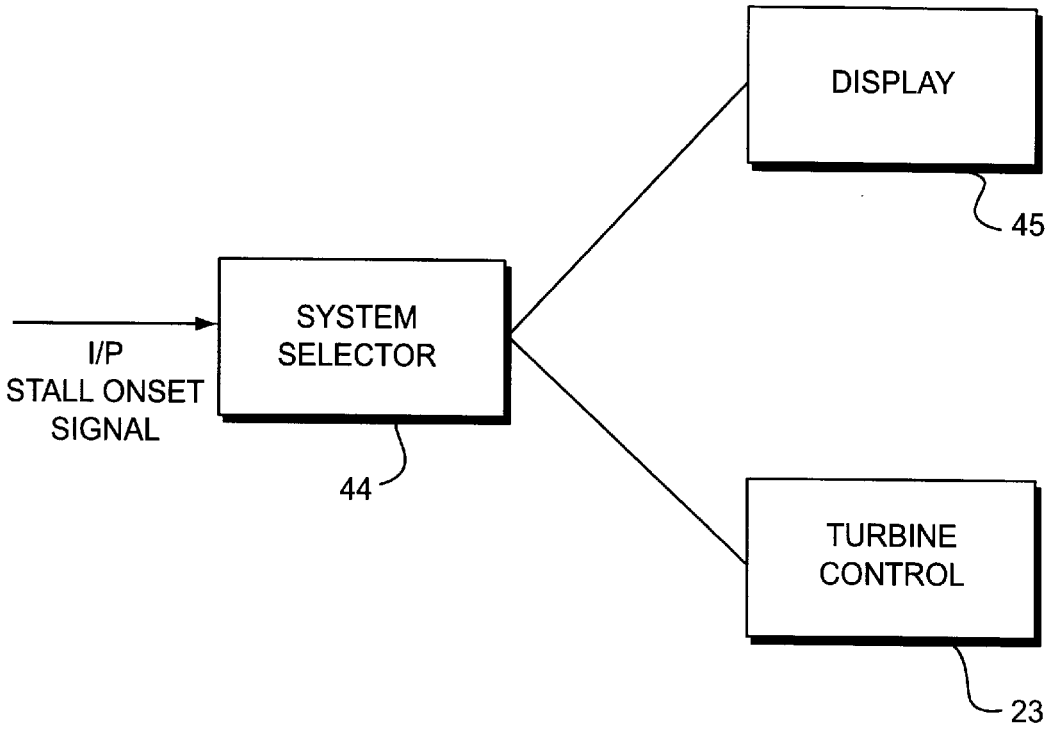
FIG. 4 illustrates a different embodiment of the present invention where a stall onset signal is selectively applied to provide a visual indication.

Referring now to FIG. 3 there is shown a chart representing deflection of one of an airfoil 22 with respect to time—airfoil deflection charted on the Y-axis and time on the X-axis. The deflection of airfoil detected at time T1 may provide a signal as indicative of onset of a compressor stall. This signal is used to initiate necessary control system corrective actions to prevent a compressor surge, thus allowing the compressor to operate with higher efficiency than if an additional margin were to be required to avoid near stall operation. In the event of requiring manual intervention, the signal indicative of stall onset may also be provided, as illustrated in FIG. 4, to a display 45 or like means in order for an operator to manually initiate corrective measures to prevent a compressor surge or near stall operation. A system selector 44 may be used to control display 45.

Figure 5:
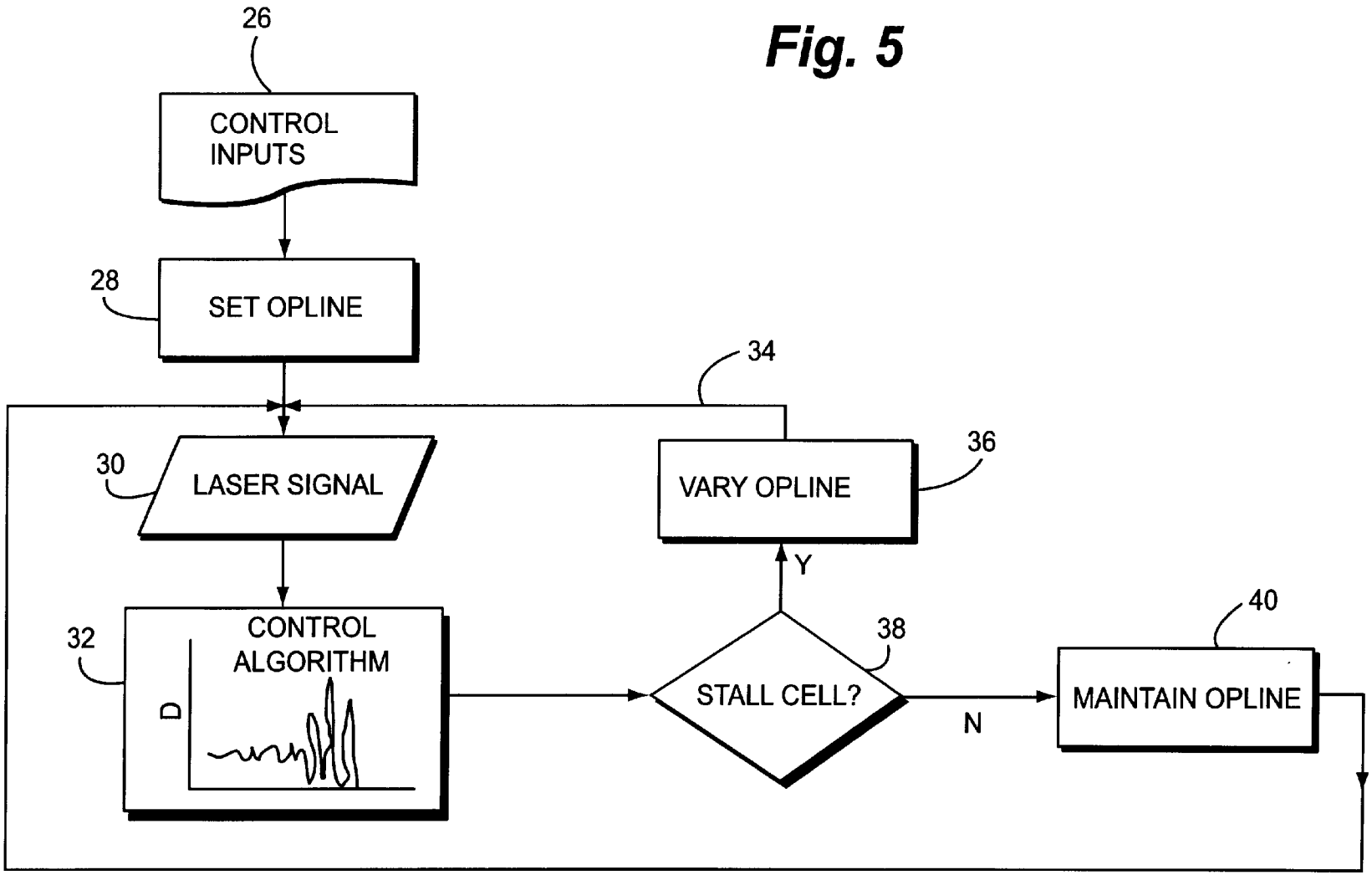
FIG. 5 illustrates a flow chart for detecting onset of a compressor stall and initiating corrective actions to prevent a compressor surge event.

Referring now to FIG. 5, there is shown a flow chart for detecting the onset of compressor stall and initiating corrective actions to prevent a compressor surge event. The control inputs at 26 provided by an operator may be used to set operating line parameters indicated at 28 for the operation of axial flow compressor 14. Once the operating line parameters are set, a laser signal 30 from one or more of the optical probes 21 is emitted towards airfoils 22. As discussed above, any deflection in an airfoil 22 is detected by at least one of the optical probes, and the measured deflections are compared with a predetermined value at 32 by a control algorithm. Airfoil deflection chart as depicted in FIG. 3 operates under the control of algorithm identified at 32.

Upon identifying a stall cell at 38, a signal to vary the operating line parameters of compressor 14 (FIG. 1) is issued at 36. Upon executing necessary corrective measures by establishing modified operating line control parameters, optical probes 21 are again caused to identify airfoil deflections. The new measurements are compared by control algorithm 32 against predetermined airfoil deflection values corresponding to the modified operating control parameters in order to determine if the measured airfoil deflection values lie within the predetermined threshold. No stall cell is detected at 38 if the new measurement is within acceptable parameters, and thus the operating line parameters are maintained at the modified operating parameter level at 40.

The process of varying the operating line parameters is iterated until the airfoil deflection is within acceptable deflection parameters, the deflection parameters being recalculated by the varied operating line control values in order to compensate for unacceptable deflection of an airfoil. It is to be understood that a particular set of acceptable airfoil deflection parameters correlate to a particular operating line control values. Thus, a specific airfoil deflection may be acceptable at a particular operating line control value, but may be unacceptable at a different operating line control value.

Figure 6:
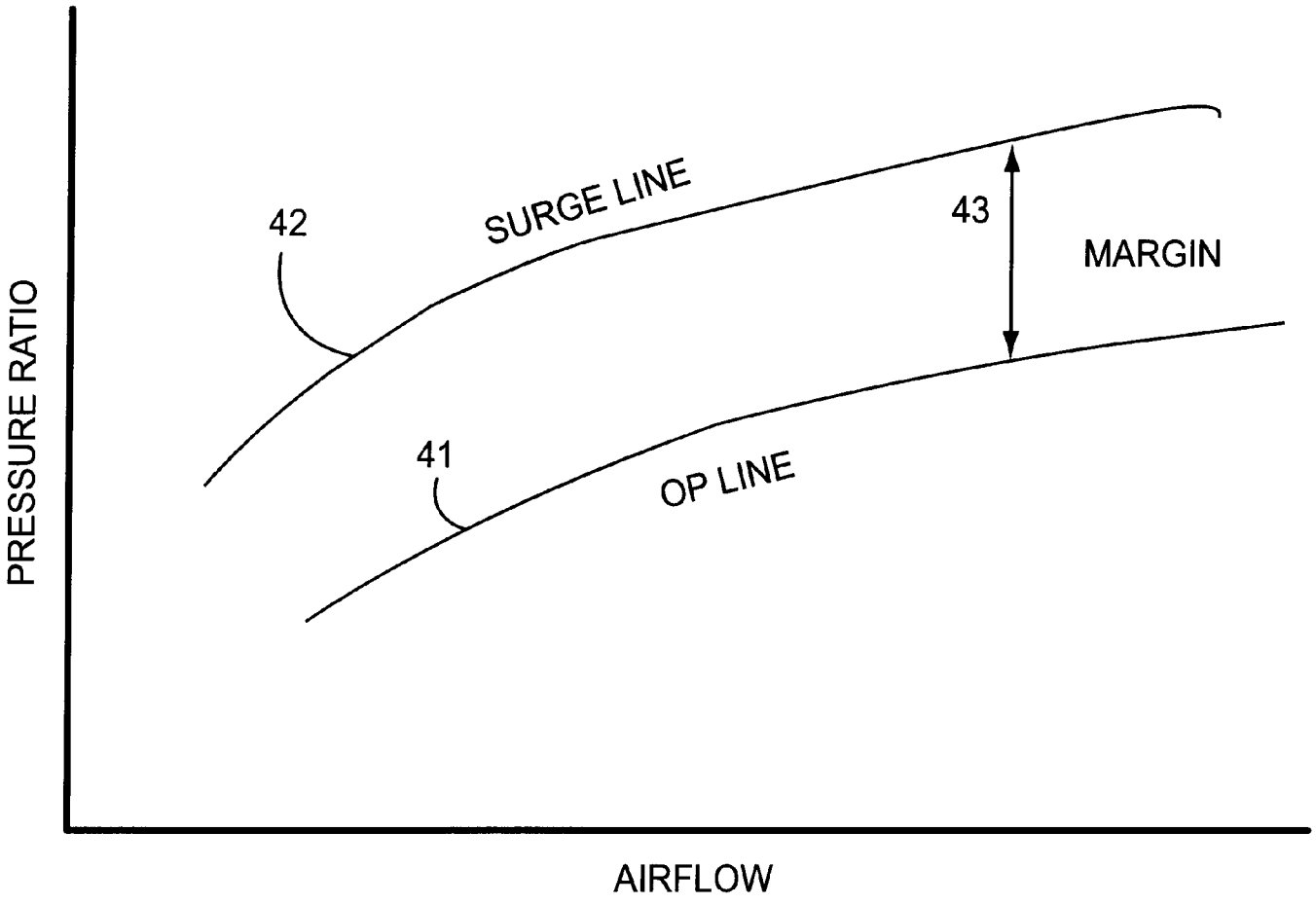
FIG. 6 depicts a chart showing a relationship between pressure ratio and airflow.

Referring now to FIG. 6, a graph charting pressure ratio on the Y-axis and airflow on the X-axis is illustrated. As previously discussed, the acceleration of a gas turbine engine may result in a compressor stall or surge wherein the pressure ratio of the compressor may initially exceed some critical value, resulting in a subsequent drastic reduction of compressor pressure ratio and airflow delivered to the combustor. If such a condition is undetected and allowed to continue, the combustor temperatures and vibratory stresses induced in the compressor may become sufficiently high to cause damage to the gas turbine. Thus, the corrective actions initiated in response to detection of an onset or precursor to a compressor stall may prevent the problems identified above from taking place. The OPLINE identified at 41 depicts an operating line that the compressor 14 is operating at. As the airflow is increased into the compressor 14, the compressor may be operated at an increased pressure ratio.

The margin 43 indicates that once the gas turbine engine 10 operates at values beyond the values set by the OPLINE as illustrated in the graph, a signal indicative of onset of a compressor stall is issued. Corrective measures by the axial flow compressor control system, which includes turbine control 23, may have to be initiated within the margin 43 in order avoid a compressor surge and near stall operation of compressor 14.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method for detecting a stall onset in an axial flow compressor system comprising, (a) providing at least one optical sensor to measure the deflection of an airfoil, said deflection caused by a rotating stall cell;

(b) comparing the deflection as measured in step (a) with a predetermined value indicative of a stall;

(c) identifying onset of a stall if said measured deflection is greater than said predetermined value;

(d) upon identifying a stall onset as in step (c), feeding the measured deflection to a control system to initiate corrective actions to prevent a compressor surge event; and (e) iterating step (d) until said measured deflection is less than said predetermined value to allow the compressor to operate at higher efficiency.

2. The method of claim 1, wherein said corrective actions are initiated by varying operating line parameters.

3. The method of claim 2, wherein said operating line parameters are set to a near threshold value.

4. A stall precursor detector system for an axial flow compressor, comprising:

at least one optical sensor to detect the deflection of an individual rotating airfoil of said compressor;

means for comparing the deflection of the individual airfoil with a predetermined value, said predetermined value being indicative of onset of a stall in said compressor; and means for identifying onset of a stall and producing a stall onset signal if said deflection is greater than said predetermined value.

5. The system of claim 4, further comprises:

a control system for initiating corrective actions to prevent a subsequent compressor surge if said deflection is greater than said predetermined value.

6. The system of claim 4, wherein said optical sensor measures the time of arrival of the individual airfoil to determine airfoil deflection.

7. A stall warning system for an axial flow compressor, comprising:

at least one optical sensor to detect and measure the deflection of an individual airfoil of said compressor;

means for comparing said deflection of the individual airfoil with a predetermined value indicative of a stall onset;

means for identifying onset of a stall if said measured deflection is greater than said predetermined value; and a feedback control system for initiating corrective actions to prevent a subsequent compressor surge upon identifying a stall onset.

8. The system of claim 7, wherein said optical sensor is a laser based system.

9. A method for detecting a stall onset in an axial flow compressor system comprising, (a) providing at least one optical sensor to measure the deflection of an airfoil, said deflection caused by a rotating stall cell;

(b) comparing the deflection as measured in step (a) with a predetermined value indicative of a stall;

(c) identifying onset of a stall if said measured deflection is greater than said predetermined value;

said deflection of the airfoil being measured by measuring the time of arrival of the airfoil with respect to a reference.

10. A stall precursor detector system for an axial flow compressor, comprising:

at least one optical sensor to detect the deflection of a rotating airfoil of said compressor;

means for comparing the deflection with a predetermined value, said predetermined value being indicative of onset of a stall in said compressor;

means for identifying onset of a stall and producing a stall onset signal if said deflection is greater than said predetermined value;

a control system for initiating corrective actions to prevent a subsequent compressor surge if said deflection is greater than said predetermined value; and a system selector means for applying the stall onset signal to provide a warning of said stall onset.

11. A method for detecting a stall onset in an axial flow compressor system comprising, (a) providing at least one optical sensor to measure the deflection of a discrete airfoil, said deflection caused by a rotating stall cell;

(b) comparing the deflection as measured in step (a) with a predetermined value indicative of a stall; and (c) identifying onset of a stall if said measured deflection of the discrete airfoil is greater than said predetermined value.

* * * * *